US005871097A

United States Patent [19]

Shida et al.

[11] Patent Number: 5,871,097

[45] Date of Patent: Feb. 16, 1999

[54] ARTICLE TRANSPORT CASE WHICH SHIELDS ARTICLE AGAINST ULTRAVIOLET LIGHT AND HUMIDITY AND ABSORBS IMPACTS

[75] Inventors: Yoshihiko Shida; Hiroto Shibata, both of Sendai, Japan

[73] Assignee: Sydek Corporation, Miyagi, Japan

[21] Appl. No.: 892,137

[22] Filed: Jul. 14, 1997

[30] Foreign Application Priority Data

Jul. 15, 1996 [JP] Japan ..... 8-185134

[51] Int. Cl.[6] ..... B65D 81/16

[52] U.S. Cl. ..... 206/521; 206/524.2; 206/524.6; 206/588; 220/339

[58] Field of Search ..... 206/521, 523, 206/587–590, 524.2, 472, 524.3, 524.6; 220/339

[56] References Cited

U.S. PATENT DOCUMENTS

| | | | |
|---|---|---|---|
| 2,217,455 | 10/1940 | Price et al. | 206/521 X |
| 3,429,424 | 2/1969 | Dow | 206/590 X |
| 3,551,940 | 1/1971 | Edison | 220/339 X |
| 4,375,262 | 3/1983 | Hrenyo | 206/523 X |
| 5,127,526 | 7/1992 | Vigue | 206/587 |
| 5,307,117 | 4/1994 | Harlan | 206/521 X |
| 5,320,226 | 6/1994 | Merrill | 206/521 |
| 5,472,091 | 12/1995 | Hewitt et al. | 206/472 X |
| 5,555,671 | 9/1996 | Voight et al. | 206/523 X |

*Primary Examiner*—Bryon P. Gehman
*Attorney, Agent, or Firm*—McDermott, Will & Emery

[57] ABSTRACT

The transport case is made of an olefin resin material mixed with an ultraviolet ray absorbing material. The transport case consists of an upper case and a lower case, which have article accommodating recesses that open to the contact surfaces that engage each other when the upper case is closed. The upper and lower cases have flanges formed around the entire circumferences of the openings and covered with thermally fusible resin films. The inner surfaces of the article accommodating recesses of the upper and lower cases are formed with support surfaces that engage an article contained in the case and also with external force absorbing expanded portions that provide gaps between the support surfaces and the article.

6 Claims, 6 Drawing Sheets

ARTICLE TRANSPORT CASE WHICH SHIELDS ARTICLE AGAINST ULTRAVIOLET LIGHT AND HUMIDITY AND ABSORBS IMPACTS

BACKGROUND OF THE INVENTION

1. Field of the Invention

The present invention relates to a case for transporting an article and more particularly to an article transport case that shields the article from ultraviolet light and humidity and protects it against damage due to impacts to which the case may be subjected during transport.

2. Description of the Related Art

When, for example, a toner cartridge for copying machines is to be transported, it is conventional practice, as shown in FIG. 9, to insert the toner cartridge B in a cylindrical cover C of aluminum vapor-deposited film and thermally fuse the ends of the cover C to form seal portions C1 to hermetically shield the toner from ultraviolet light and humid air and thereby prevent deterioration of toner quality. Furthermore, to protect the toner cartridge B against damage during transport, the ends of the aluminum vapor-deposited film cover C containing the toner cartridge B are fitted into shock absorbing blocks D and then a plurality of these toner cartridges B are put in a cardboard box in multiple tiers, and packed and delivered to a destination.

The shock absorbing block D is made by forming an impact absorbing material. The top and bottom surfaces of the shock absorbing blocks D are flat parallel surfaces and thus constitute stacking surfaces when the cartridges are stacked in multiple tiers in the cardboard box.

The packing and transport method described above has the following problems.

(1) Before putting the toner cartridges in a cardboard box, two processes are required. One is to insert the toner cartridges in aluminum vapor-deposited film covers and hermetically seal them, and the other is to fit the shock absorbing blocks over the ends of the aluminum vapor-deposited film cover. These processes are inefficient manual works and take a lot of time, making the packing work costly.

(2) After the toner cartridge is taken out of the cardboard box, two works are necessary: one is to remove the shock absorbing blocks and the other is to open the cover of the aluminum vapor-deposited film and take out the toner cartridge. These works are inefficient manual works, making the unpacking process time-consuming.

(3) Because the packing of the toner cartridge uses the aluminum vapor-deposited film cover and the shock absorbing blocks, the packing material cost is high.

(4) The shock absorbing blocks need to be large enough to be fitted over the ends of the aluminum vapor-deposited film cover, which means the block's volume is large and that the site for the packing work must be spacious enough to temporarily accommodate a large number of shock absorbing blocks.

Further, to temporarily accommodate the removed shock absorbing blocks during unpacking requires a large space. When the removed shock absorbing blocks are transported to a disposal site, the transport volume is large increasing the transport cost.

SUMMARY OF THE INVENTION

The present invention is intended to provide an article transport case that solves the above-mentioned problems.

In order to attain the object, according to this invention, there is provided an article transport case which comprises: an upper case and a lower case, made of an olefin-based resin material mixed with an ultraviolet ray absorbing substance such as titanium oxide; article accommodating recesses formed in the upper case and the lower case and opening to contact surfaces of the upper case and the lower case, the contact surfaces being adapted to engage each other; flanges formed around the entire circumferences of the recesses to provide the contact surfaces and covered with thermally fusible resin films; article support surfaces formed in inner surfaces of the article accommodating recesses to engage outer surfaces of an article; and external force absorbing expanded portions formed in inner surfaces of the article accommodating recesses such that spaces are provided between their defining surfaces and outer surfaces of the article when the latter is accommodated.

Preferably, the external force absorbing expanded portions are formed at least at four corners of the article accommodating recesses and the heights from the contact surfaces to the outermost surface of the external force absorbing expanded portions of the four corners are substantially equal.

The upper case and the lower case is advantageously integrally coupled together at one end with a flexible hinge portion.

Preferably, one of the flanges of the upper and lower cases is provided with notch portions at corners and the other flange is formed with grip projections at positions corresponding to the notch portions so that the grip projections can be used to peel the flanges from each other.

The thermally fusible resin film is preferably laminated over the flange surfaces.

The above and other objects, features and advantages of this invention will become apparent from the following description and the appended claims, taken in conjunction with the accompanying drawings in which like parts or elements are denoted by like reference characters.

DESCRIPTION OF THE PREFERRED EMBODIMENTS

Figure 1:
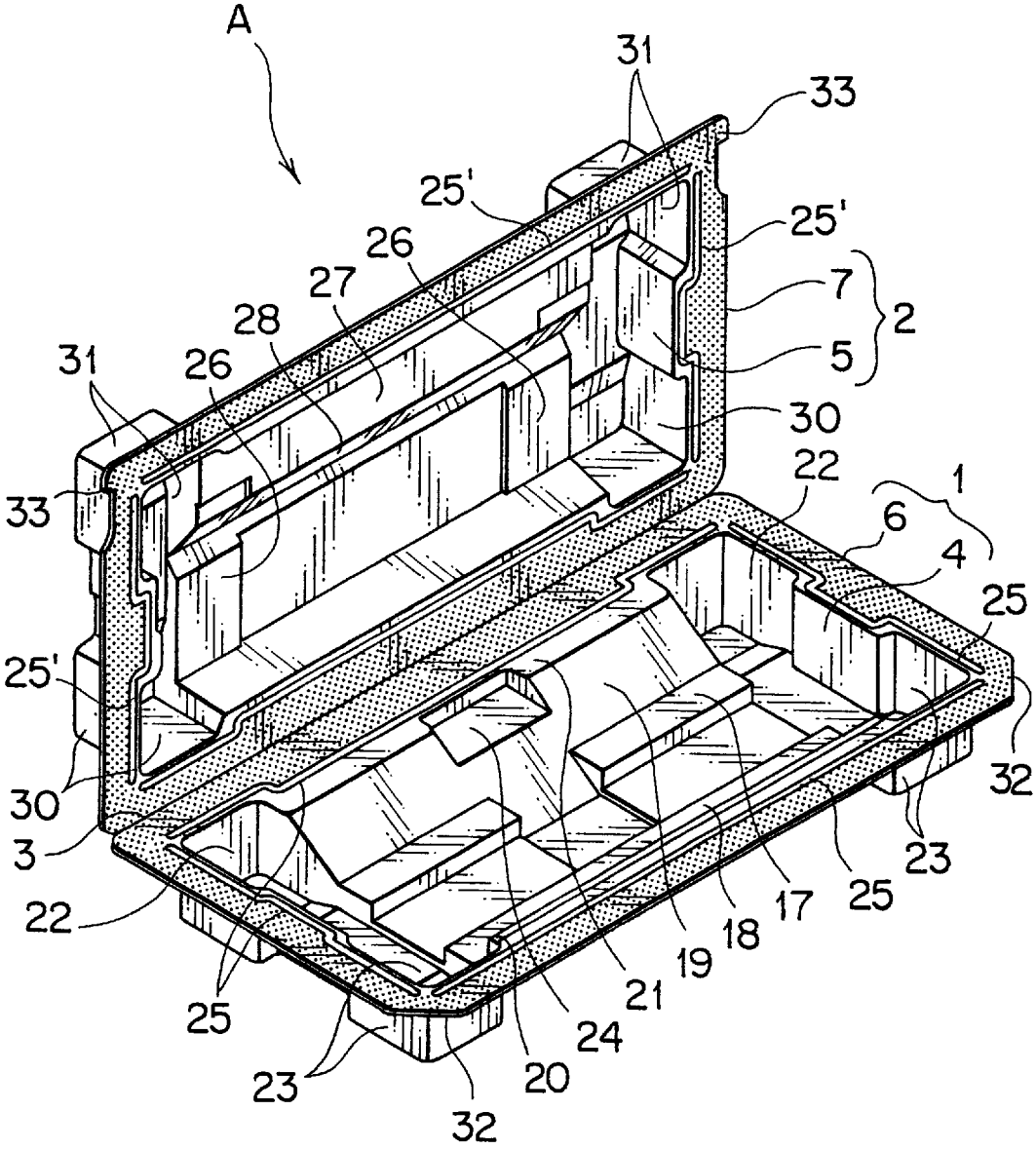
FIG. 1 is a perspective view of an article transport case A according to the present invention, shown in an open state.
Figure 2:
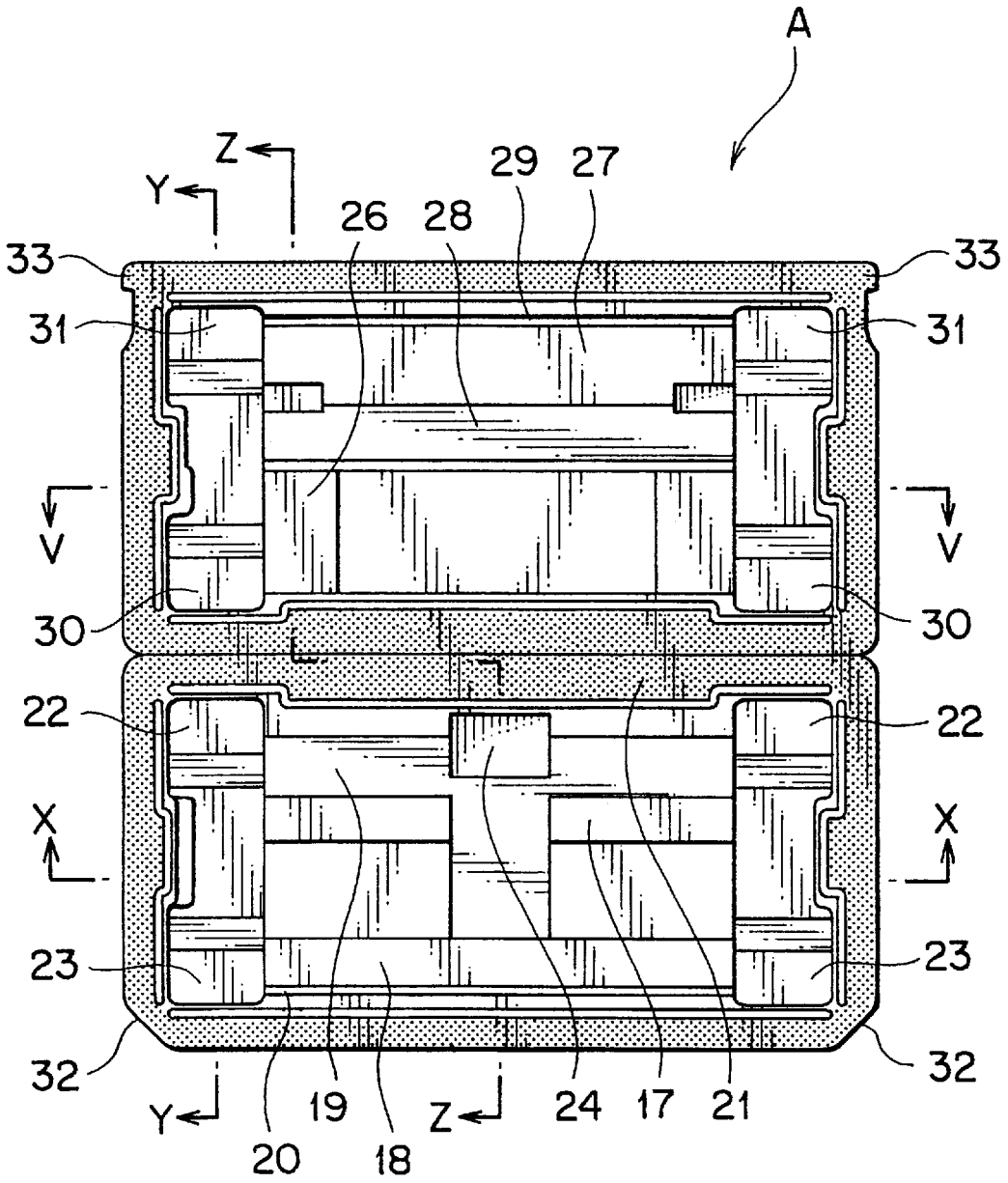
FIG. 2 is a plan view of the fully open article transport case A.
Figure 7:
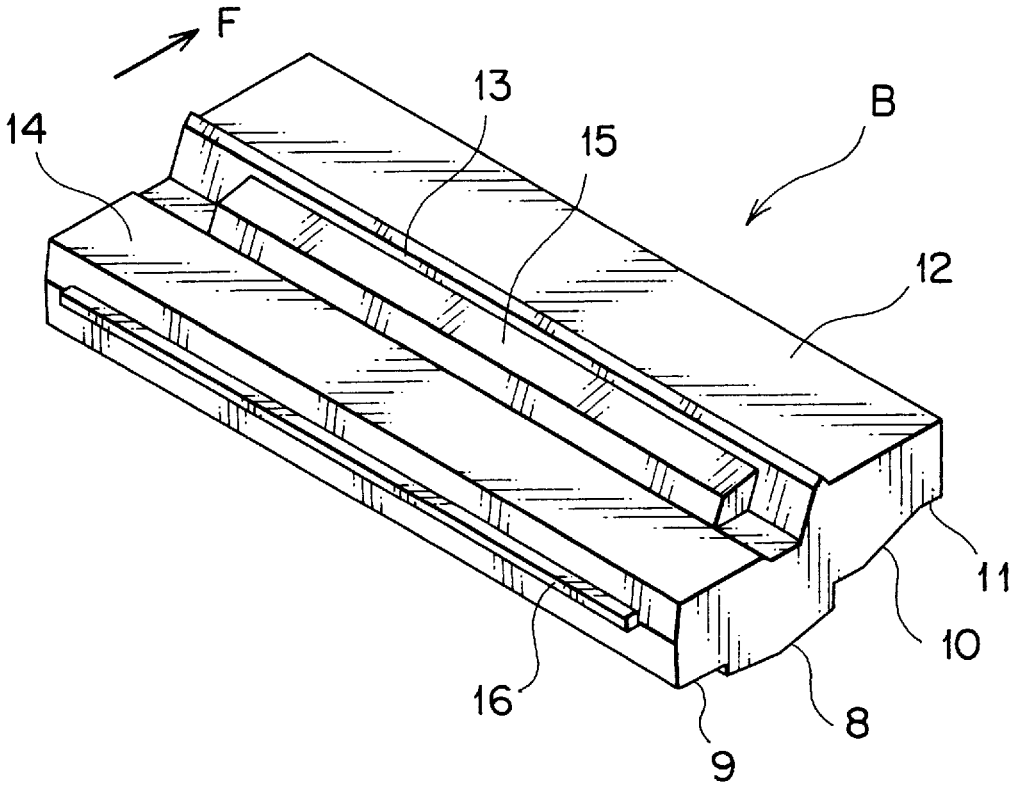
FIG. 7 is a perspective view of a toner cassette B as one example of an article to be transported.

A preferred embodiment of this invention will be described in detail with reference to the accompanying drawings. FIG. 1 is a perspective view of a article transport case A in an open state. FIG. 2 is a plan view of the fully open article transport case A. FIG. 7 is a perspective view of an article B to be accommodated in the article transport case A and transported, which is a toner cassette.

The transport case A is made by forming an olefin-based resin mixed with an ultraviolet ray absorbing material such as titanium oxide. A part 3 integrally connecting a lower case 1 and an upper case 2 is deflectable and thus constitutes a hinge portion 3 for opening and closing the upper case 2 (see FIG. 1).

Figure 3:
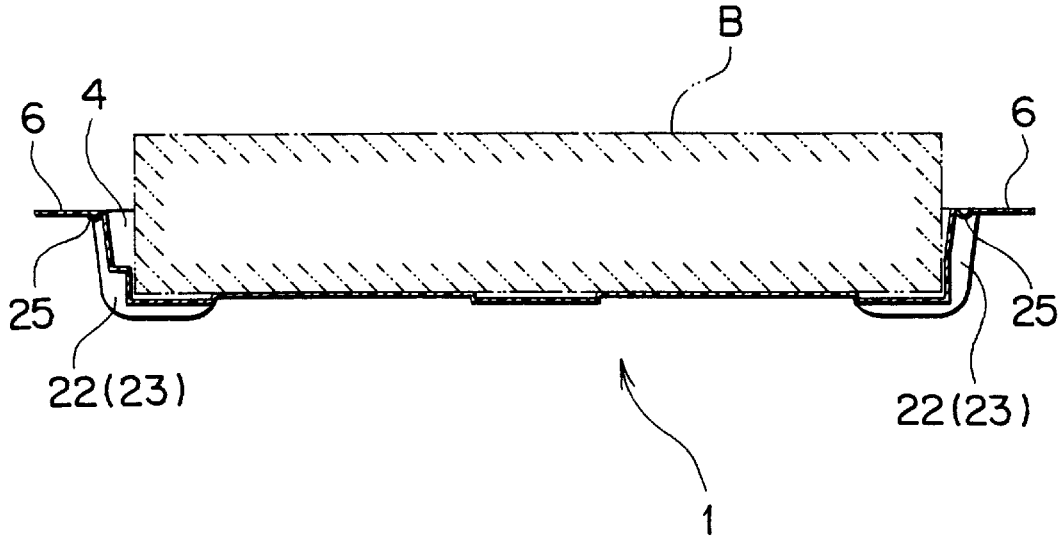
FIG. 3 is a cross section taken along the line V—V of FIG. 2.
Figure 4:
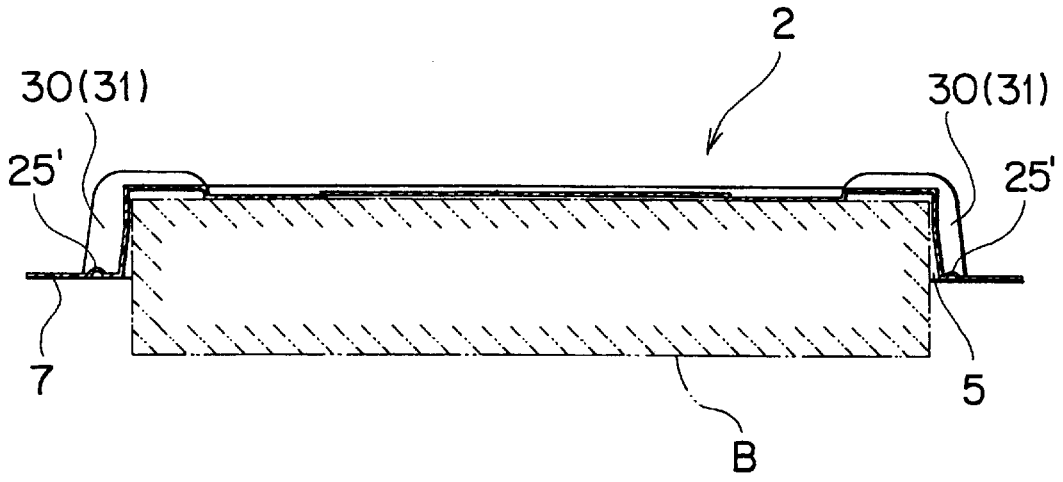
FIG. 4 is a cross section taken along the line X—X of FIG. 2.

The lower case 1 and the upper case 2 are formed almost uniform in thickness and have article accommodating recesses 4, 5 that open to the superimposing contact faces. The article accommodating recess 4 of the lower case 1 receives the lower half of the object B to be transported (FIG. 3) and has a flange 6 along the entire circumference of the opening of the article accommodating recess 4. The article accommodating recess 5 of the upper case 2 receives the upper half of the article B (FIG. 4) and has a flange 7 along the entire circumference of the opening of the article accommodating recess 5.

As for the external shape of the article B to be accommodated in the transport case A and transported, if the direction of arrow F in FIG. 7 is taken to be the forward direction, the article B has a rear stepped portion 9 formed at the rear end of a lowermost underside 8 and a front stepped portion 11 at the front end of an inclined surface 10 that is continuous to the lowermost underside 8.

On the upper side the article B has an uppermost surface 12 at the front part, a raised strip 13 formed at the rear end of the uppermost surface 12, a low upper surface 14 formed on the rear side of the raised strip 13, an open-close cover 15 provided on the low upper surface 14, and a projected strip 16 projecting from the rear end face of the article B (FIG. 7).

Inner walls of the article accommodating recess 4 include an underside support surface 17 on which rests the lowermost underside 8 of the article B to be transported, a stepped portion support surface 18 on which is put the rear stepped portion 9, an inclined surface support surface 19 for supporting the inclined surface 10, and a projected strip support surface 20 which the underside of the projected strip 16 engages. The underside of the front stepped portion 11 of the article B is placed on a stepped portion support surface 21 equal in height to the flange 6 (see FIG. 1).

At two of the four corners of the article accommodating recess 4, there are provided external force absorbing expanded portions 22 in which the front lateral ends of the article B are to be placed. At the remaining two corners where the rear lateral ends of the article B are to be placed, external force absorbing expanded portions 23 are provided (FIG. 1 and FIG. 2).

Figure 5:
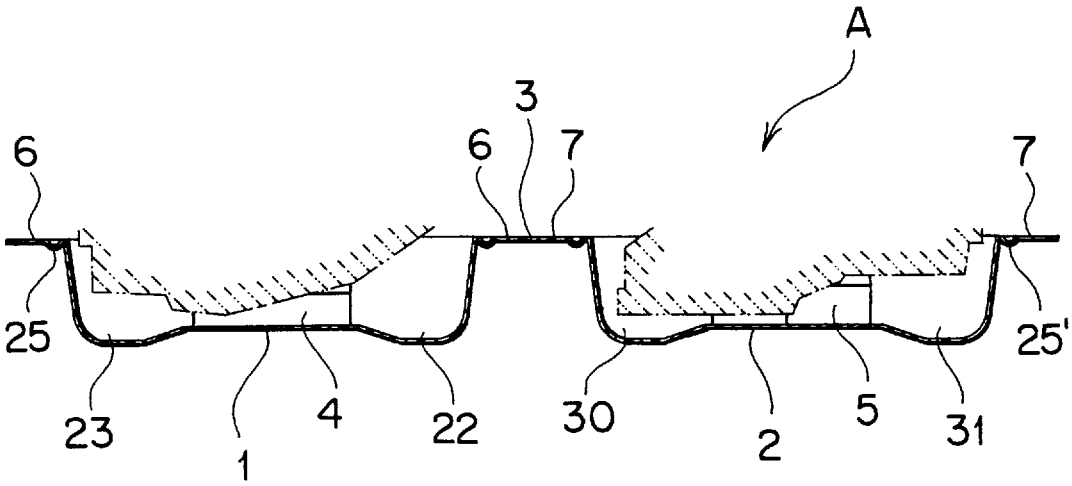
FIG. 5 is a cross section taken along the line Y—Y of FIG. 2.
Figure 6:
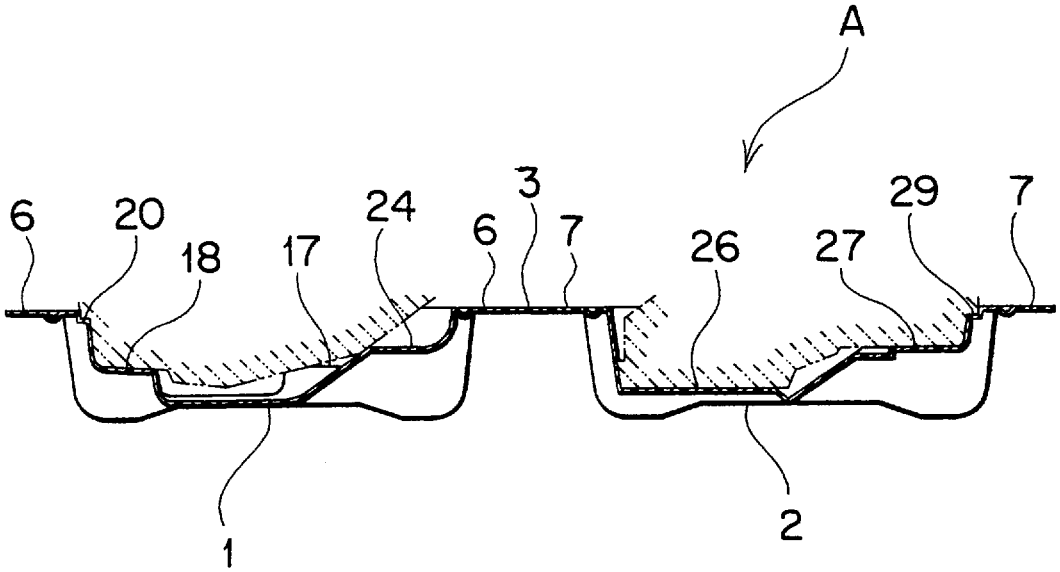
FIG. 6 is a cross section taken along the line Z—Z of FIG. 2.

There are clearances between the inner surfaces of the external force absorbing expanded portions 22 and the front, side and bottom surfaces of the front lateral ends of the article B. Clearances are also formed between the inner surfaces of the external force absorbing expanded portions 23 and the rear, side and bottom surfaces of the rear lateral ends of the article B (see FIG. 3 and 5).

Figure 8:
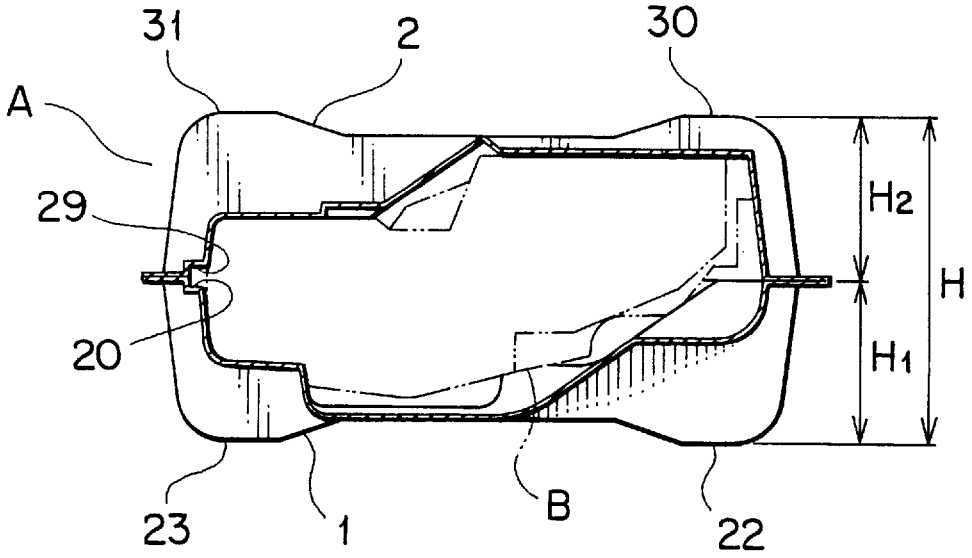
FIG. 8 is a cross section of the toner cassette B installed in the transport case A.
Figure 9:
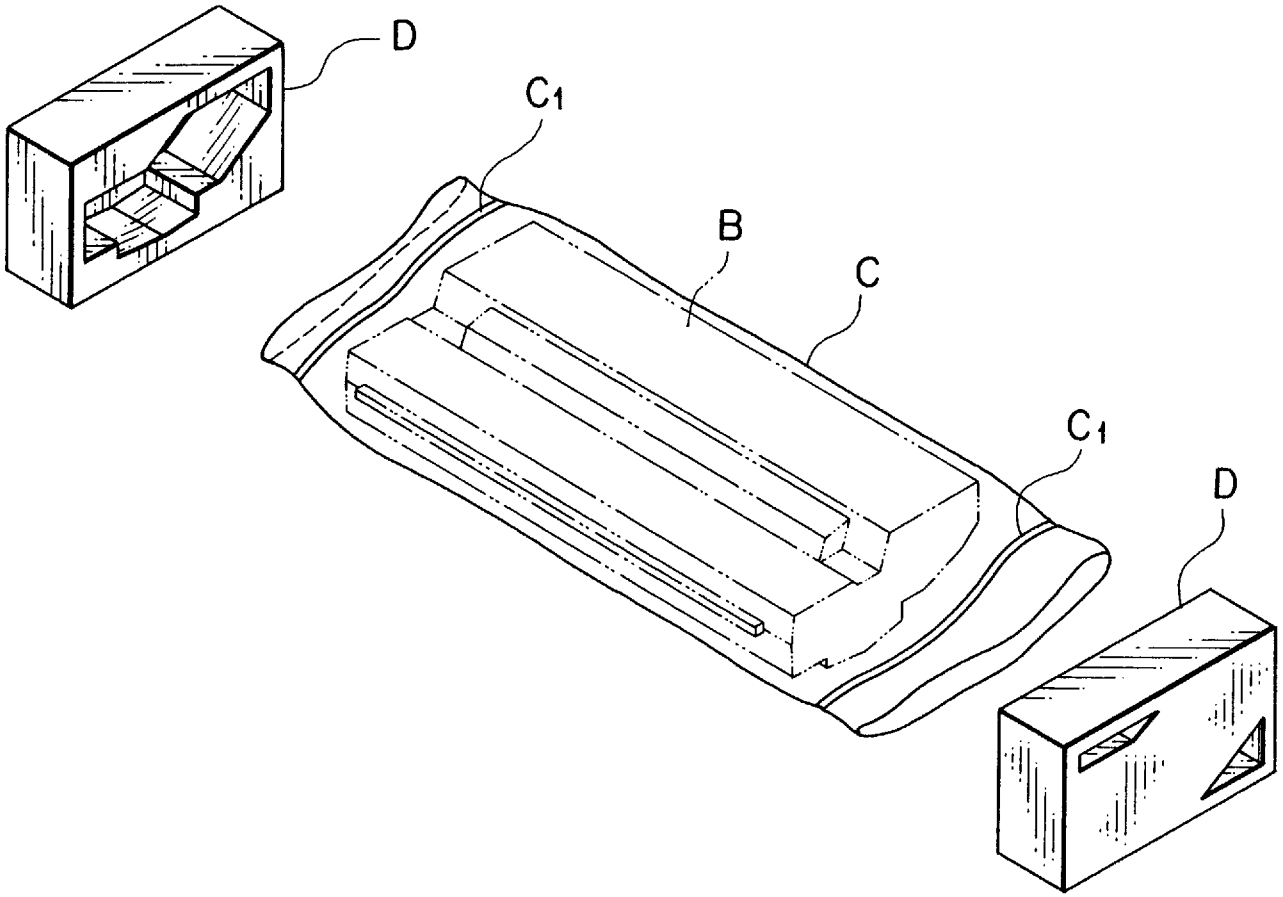
FIG. 9 PRIOR ART
FIG. 9 is a perspective view showing how the conventional packing of goods to be transported is performed to protect the goods from ultraviolet light and humidity and from impacts.

The heights H1 from the flange 6 to the top (outermost) surfaces of the external force absorbing expanded portions 22, 23 are equal (FIG. 8).

The external force absorbing expanded portions 22, 23 are elastically deformed when applied with an outer force. When subjected to a greater force, they will deform partially plastically. But because there are clearances between the inner surfaces of the external force absorbing expanded portions 22, 23 and the corners of the article B, the article B is not damaged. That is, the external force absorbing expanded portions 22, 23 work as a crushable zone.

A recess 24 formed at the center of the inclined surface support surface 19 and the stepped portion support surface 21 provides a space to insert fingers when removing the article B from the article accommodating recess 4. This facilitates the removal of the article. The flange 6 of the lower case 1 is formed with reinforcement ribs 25 whose upper surfaces are recessed and lower surfaces are raised (FIG. 1).

Inner walls of the article accommodating recess 5 of the upper case 2 include upper surface support surfaces 26 which the uppermost surface 12 of the article B at portions near their lateral ends engage, an upper surface support surface 27 which the low upper surface 14 engages, an inclined surface 28 close to the open-close cover, and a projected strip support surface 29 (FIG. 2) which the upper surface of the projected strip 16 engages. The flange 7 of the upper case 2 is formed with reinforcement ribs 25' similar to the reinforcement ribs 25 of the lower case 1 (see FIG. 1).

Of the four corners of the article accommodating recess 5, two corners where the front lateral ends of the article B are placed are provided with external force absorbing expanded portions 30. The remaining two corners in which the rear lateral ends of the article B are placed are provided with external force absorbing expanded portions 31 (FIG. 1 and 2). The external force absorbing expanded portions 30, 31 have the same structure to the external force absorbing expanded portions 22, 23 of the lower case 1 and form crushable zones to protect the article B from external forces.

The heights H2 from the flange 7 to the top (outermost) surfaces of the external force absorbing expanded portions 30, 31 are equal. The sum of this height H2 and the height H1 of the external force absorbing expanded portions 22, 23 of the lower case 1 represents the height H of the transport case A (FIG. 8). When the transport cases A are stacked in layers in a cardboard box, the external force absorbing expanded portions 22, 23 of one transport case A are placed on the outer wall surfaces of the external force absorbing expanded portions 30, 31 of a neighboring transport case A.

Two corners of the flange 6 of the lower case 1 are formed with notched portions 32, and the flange 7 of the upper case 2 has grip projections 33 at corners corresponding to the notched portions 32 to facilitate the opening operation (FIG. 1). When the flanges 6, 7 are held together, the grip projections 33 protrude from the notched portions 32 so that the grip projections 33 can be easily gripped by fingers for separating the upper and lower cases.

The flange 6 of the lower case 1 and the flange 7 of the upper case 2 are laminated with a thermally fusible resin film over their entire surfaces. When the flanges 6, 7 are held together and heated, their contact surfaces are fused together to seal the inner space of the transport case A airtight Now, the process of packing (accommodating the articles B in the transport cases, and stacking and accommodating them in a cardboard box) and unpacking after transport of the cases A of the above construction will be explained.

First, the upper case 2 is opened with the hinge portion 3 as a fulcrum and the article B is inserted in the article accommodating recess 4 of the lower case 1, after which the upper case 2 is closed. Next, the whole surfaces of the flanges 6, 7 are fused together to seal the article B in the case A against external humidity.

Because the transport case A is formed of an olefin resin material mixed with an ultraviolet light absorbing material, the article B in the case A is shielded against ultraviolet light. Further, the article B is clamped between the support surfaces 17, 18, 19, 20 of the lower case 1 and the support surfaces 26, 27, 29 of the upper case 2, so that the article B does not move inside the case vertically or longitudinally. There are gaps in the case in the lateral direction along which the article can slide slightly. But the article B is prevented from becoming loose inside.

Because the transport cases A containing the articles B are all set to the height H at the four corners, they can be stacked in the cardboard box in an orderly manner. Further, because the four corners of the transport case A have a gap between the case wall and the article B contained therein, the stacking weight is not applied directly to the article B.

The transport case A is made of an olefin resin material and has a significant elasticity. Because of the article accommodating recess 4 with recessed and raised complex surfaces and the reinforcement ribs 25 on the flange 6 and because of the article accommodating recess 5 with recessed and raised complex surfaces and the reinforcement ribs 25' on the flange 7, the lower case 1 and the upper case 2 exhibit a significant rigidity and thus can withstand impacts and vibrations. Further, the external force absorbing expanded portions 22, 23, 30, 31 absorb external forces and protect the article B inside.

When, after transport, the article B is to be taken out of the transport case A, the user grips the grip projections 33 and peels the flange 7 off the mating flange 6. The flange 7 easily separates from the flange 6 allowing the user to pick up the article B easily.

If inner surfaces of the article accommodating recesses 4, 5 are provided with slight inclinations that expand toward the openings of the article accommodating recesses 4, 5, the transport cases A after the articles B are taken out can be stacked easily in a fully open state as shown in FIG. 2, which alleviates the need for a large space for temporary storage of the transport cases A and reduces the transport volumes.

While the above embodiment refers to the case where the article B to be transported is a toner cassette, it is also possible to provide the transport case in a shape that conforms to any other article than the toner cassette, so that the transport case can shield the article against ultraviolet light and humidity and absorb impacts.

Because of the construction described above, this invention offers the following advantages.

(1) An article can be easily installed in the transport container by a simple procedure of inserting the article into the transport case and closing the upper case through the hinge portion. The article can also be sealed hermetically against humidity simply by fusing together the upper and lower flanges. Thus, the manual packing work can be made very simple. Because the four corners of the upper and lower surfaces of the transport case are formed with external force absorbing expanded portions, the transport cases can easily be stacked in a cardboard box. This in turn reduces the packing cost.

(2) Because the flange can be peeled off easily by picking the grip projection of the flange, the article can be taken out of the transport case easily.

(3) Because the material of the transport case contains a substance that shields ultraviolet rays, it is possible to protect the article from ultraviolet rays.

(4) Because the external force absorbing expanded portions provided at the four corners of the upper and lower surfaces of the transport case absorb external vibrations and impacts, the article can be protected from those vibrations and impacts.

(5) Because the transport case is a single component and can be produced efficiently by molding at low cost and because it is light in weight, the packing work can be done easily. Further, because the transport case is compact, only a small space for work and temporary storage is needed and the transport cost can be reduced.

Having now fully described the invention, it will be apparent to one of ordinary skill in the art that many changes and modifications can be made thereto without departing from the spirit and scope of the invention as set forth herein.

What is claimed is:

1. An article transport case comprising:

an upper case and a lower case, made of an olefin-based resin material mixed with an ultraviolet ray absorbing substance;

article accommodating recesses formed in said upper case and said lower case and opening to contact surfaces of said upper case and said lower case, said contract surfaces being adapted to engage each other;

flanges formed around entire circumferences of said recesses to provide said contact surfaces and covered with thermally fusible resin films;

article support surfaces formed in inner surfaces of said article accommodating recesses to engage outer surfaces of an article; and external force absorbing expanded portions formed in inner surfaces of said article accommodating recesses such that spaces are provided between their defining surfaces and outer surfaces of the article when the article is accommodated.

2. The article transport case according to claim 1, wherein said external force absorbing expanded portions are formed at least at four corners of said article accommodating recesses, and the heights from said contact surfaces to the outermost surface of said external force absorbing expanded portions of the four corners are substantially equal.

3. The article transport case according to claim 1, wherein said upper case and said lower case are integrally coupled together at one end with a flexible hinge portion.

4. The article transport case according to claim 1, wherein one of said flanges of said upper and lower cases is provided with notch portions at corners and the other flange is formed with grip projections at positions corresponding to said notch portions, said grip projections being used for peeling said flanges from each other.

5. The article transport case according to claim 1, wherein said thermally fusible resin film is laminated over surfaces of the flanges.

6. The article transport case according to claim 1, wherein said ultraviolet ray absorbing substance is titanium oxide.

* * * * *